US005902151A

United States Patent [19]

Havener et al.

[11] Patent Number: 5,902,151

[45] Date of Patent: May 11, 1999

[54] CIRCULAR DIN CONNECTOR

[75] Inventors: Jacob Glenn Havener, Gastonia, N.C.; Gregory Padraic Grogan, Tigard; Patricia Chelap Williamson, Portland, both of Oreg.

[73] Assignee: The Whitaker Corporation, Wilmington, Del.

[21] Appl. No.: 08/866,504

[22] Filed: May 30, 1997

[51] Int. Cl.[6] ..... H01R 13/648

[52] U.S. Cl. ..... 439/607; 439/940

[58] Field of Search ..... 439/607, 56, 58, 439/609, 610, 940

[56] References Cited

U.S. PATENT DOCUMENTS 4,637,669 1/1987 Tajima ..... 439/609

5,007,862 4/1991 Defibaugh et al. ..... 439/607

OTHER PUBLICATIONS

*AMP Catalog 82212*, "Shielded Miniature Circular DIN Connectors," four pages; Jan. 1995; AMP Incorporated, Harrisburg, PA.

*Primary Examiner*—Steven L. Stephan
*Assistant Examiner*—Eugene G. Byrd
*Attorney, Agent, or Firm*—Anton P. Ness

[57] ABSTRACT

Connector (10) having a mating face (16) and an opposed board-mounting face (18) and having an outer metal shield (12) therearound with an annular transverse flange (40). Opposed notches (46) into the peripheral edge surface (48) of the flange enable gripping by robotic equipment for accurate placement of the connector onto a circuit board.

1 Claim, 1 Drawing Sheet

CIRCULAR DIN CONNECTOR

FIELD OF THE INVENTION

The present invention is related to the field of electrical connectors and more particularly to connectors mountable on circuit boards.

BACKGROUND OF THE INVENTION

An electrical connector is known from U.S. Pat. No. 5,007,862, and such a connector is sold by AMP Incorporated, Harrisburg, Pa. as the Miniature Circular DIN Connector. The connector has an outer metal shield about an insulative insert containing a plurality of contacts that extend in respective passageways from a board-mounting face to an opposed mating face both of which are exposed by the outer shield. An inner shield is disposed in an annular recess of the insert. The outer shield is circular and includes a transverse flange extending outwardly to seat against the periphery of the cutout of a panel through which the connector extends for mating with a complementary connector; a portion of the flange is enlarged to provide an aperture therethrough for receipt of a grounding bolt of the panel.

It is desired to provide for accurate placement by robotic equipment onto a circuit board during circuit board assembly.

SUMMARY OF THE INVENTION

In the present invention, a pair of diametrically opposed notches are defined in the transverse flange of the outer metal shield of a board-mountable shielded connector. The notches enable gripper tooling of the robotic equipment to seat in the notches thereby establishing a reference between the connector and the equipment that enables the equipment to maintain the orientation and angular position of the connector facilitating placement of the connector onto the circuit board accurately at a known position in a known orientation.

An embodiment of the present invention will now be described by way of example with reference to the accompanying drawings.

DETAILED DESCRIPTION

Figure 1:
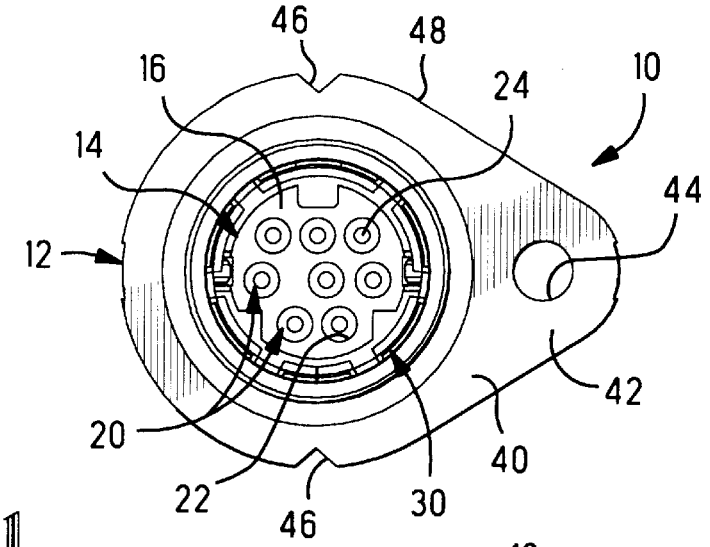
FIG. 1 is a plan view of the connector of the present invention.
Figure 2:
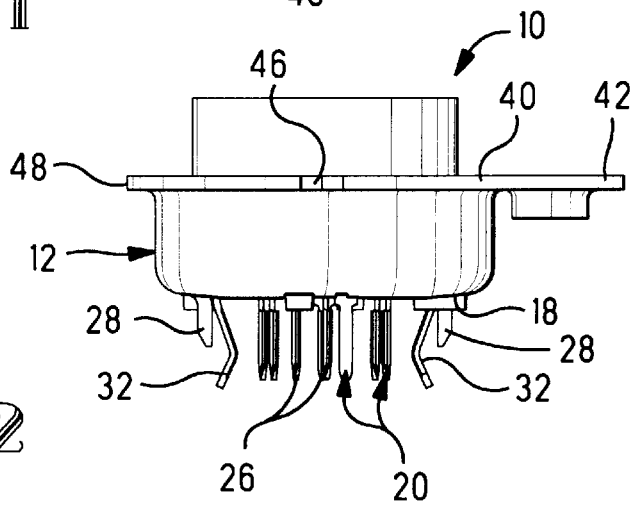
FIG. 2 is an elevation view thereof.

Connector 10 includes an outer metal shield 12 in which an insulative insert 14 is secured that extends through the metal shield from a mating face 16 to a board-mounting face 18. A plurality of contacts 20 is secured within respective passageways 22 with first contact sections 24 exposed along mating face 16 and second contact sections 26 extending beyond board-mounting face 18 to be electrically connected to circuits of a circuit board (not shown) such as by being inserted into through-holes of the board whereafter they preferably are soldered. Outer metal shield 12 preferably includes legs 28 depending below board-mounting face 18 that are received into mounting holes of the circuit board for grounding to a ground circuit of the board and to assist in connector retention to the board. An inner metal shield 30 is contained within an annular groove of the insert and includes legs 32 that depend below mounting face 18 that are received into board holes for retention to the board at least until soldering of the second contact sections is performed, and legs 32 also establish a ground connection with ground circuits of the board.

During mounting of connector 10 onto a circuit board, second contact sections 26 and legs 28 and 32 must first be aligned with the respective holes through the board. Generally the through-hole pattern and the corresponding pattern of second contact sections 26, is asymmetrical. Outer metal shield 12 includes a transverse flange 40 extending circumferentially therearound so that upon mounting of the circuit board within a conductive outer panel of a piece of electronic equipment, the flange abuts portions of the panel surrounding the cutout through which the connector extends to become mated with a connector on the outside of the panel. Flange 40 includes an enlarged mounting ear 42 that includes an aperture 44 therethrough for receipt of the grounding bolt to ground the shield to the panel.

Figure 3:
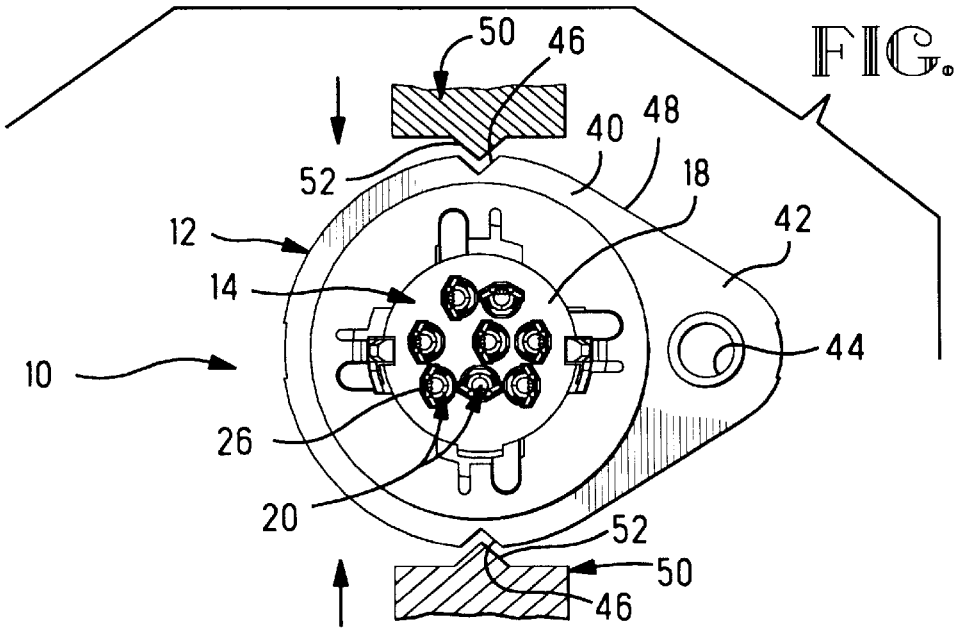
FIG. 3 is a bottom view of the connector of FIGS. 1 and 2.

In accordance with the present invention, a pair of diametrically opposed notches 46 are formed into outer edge surfaces 48 of transverse flange 40. As is seen in FIG. 3, notches 46 enable seating of opposed grippers 50 of robotic pick-and-place equipment, during gripping of connector 10. Notches 46 are formed at locations selected to correspond with the known arrangement of contacts 20 and legs 28 of outer metal shield 12 and legs 32 of inner metal shield 30, so that upon gripping of connector 10 by complementary portions 52 of the grippers, the reference is conveyed to the controller of the robotic equipment enabling the controller to know and thus to control the angular position as well as the location of the connector. Notches 46 further provide improved control of movement of connector 10 than is available from continuously annular peripheral edges of transverse flange 40, especially including control over the tendency of the connector to tilt incrementally. Optionally, the notches may be dissimilar for polarization purposes, along with associated dissimilar complementary gripper portions.

What is claimed is:

1. A shielded electrical connector, comprising:

an insulative insert having a plurality of contacts contained therein extending from first contact sections exposed along a mating face to second contact sections extending from a board-mounting face for connection to circuits of a circuit board upon connector mounting thereto, and at least an outer metal shield surrounding and containing said insert while exposing said mating face and said board-mounting face, said outer metal shield having a transverse flange extending outwardly therefrom to a generally circular peripheral edge surface and being disposed annularly around said metal shield, and at least a pair of opposed notches into said peripheral edge surface, whereby grippers of robotic placement equipment having complementary portions grip the connector in a manner controlling the location, orientation and angular position of the connector to accurately place the connector onto a connector site of a circuit board for connection of said second contact sections to board circuits.

* * * * *